US005917120A

United States Patent [19]

Rommel et al.

[11] Patent Number: 5,917,120

[45] Date of Patent: Jun. 29, 1999

[54] RESIST PRINTING ON HYDROPHOBIC FIBRE MATERIALS

[75] Inventors: Rudolf Rommel, Münchenstein; Peter Johnson, Therwil, both of Switzerland

[73] Assignee: Ciba Specialty Chemicals Corporation, Tarrytown, N.Y.

[21] Appl. No.: 08/933,592

[22] Filed: Sep. 19, 1997

[30] Foreign Application Priority Data

Sep. 20, 1996 [CH] Switzerland ..... 2310/96

[51] Int. Cl.[6] ..... D06P 3/54

[52] U.S. Cl. ..... 8/445; 8/464; 8/485; 8/478; 8/922; 8/606

[58] Field of Search ..... 8/606, 554–556, 8/478, 485, 456, 464, 445, 922

[56] References Cited

U.S. PATENT DOCUMENTS

| | | | |
|---|---|---|---|
| 3,964,862 | 6/1976 | Kangle et al. | 8/176 |
| 4,362,530 | 12/1982 | Gross et al. | 8/529 |
| 4,398,914 | 8/1983 | Blum et al. | 8/456 |
| 4,421,516 | 12/1983 | Stahl et al. | 8/464 |
| 4,428,750 | 1/1984 | Birke et al. | 8/461 |
| 5,209,758 | 5/1993 | Traber et al. | 8/526 |

FOREIGN PATENT DOCUMENTS 4310919 10/1994 Germany .

*Primary Examiner*—Margaret Einsmann
*Attorney, Agent, or Firm*—Kevin T. Mansfield; David R. Crichton

[57] ABSTRACT

The present invention relates to a process for printing hydrophobic fibre materials with disperse dyes, which comprises a procedure in which the fibre materials A) are dyed over the entire area or printed over the entire area with a disperse dye and B) are printed in areas with a printing paste comprising
at least one disperse dye,
at least one cationic dyeing assistant and
at least one nonionic detergent it being possible for steps A) and B) to be carried out in any sequence and for step B) to be repeated several times with different dyes, the fibre material treated in this way is dried and the dye is then fixed on the fibre material by a heat treatment.

Multicolored prints with sharp contours and very good fastnesses to hot light are obtained by the process according to the invention.

6 Claims, No Drawings

RESIST PRINTING ON HYDROPHOBIC FIBRE MATERIALS

The present invention relates to a process for printing hydrophobic fibre materials with disperse dyes by the resist printing process.

The resist printing process with disperse dyes is known for hydrophobic fibre materials. However, printing of these materials, in particular polyester fibre materials, is usually carried out by a so-called discharge resist process, in which the predyed or preprinted ground dye is destroyed locally by a treatment with a strongly alkaline dyeing assistant and one or more other dyes, which must be discharge-resistant, are printed onto these areas. However, treatment with the discharge agent has both ecological and economic disadvantages; thus, for example, the treated fibre material may be attacked and damaged by the action of strong alkali.

There is therefore a need for a simpler resist printing process, which is gentle on the fibre, for printing hydrophobic fibre materials, in particular polyester fibre materials.

It has been found, surprisingly, that hydrophobic fibre material can be printed in a manner which is gentle on the fibre by the process according to the invention, the resulting print having good all-round properties, and in particular a very good fastness to hot light.

The present application thus relates to a process for printing hydrophobic fibre materials with disperse dyes, which comprises a procedure in which the fibre materials:

A) are dyed over the entire area or printed over the entire area with a disperse dye and B) printed in areas with a printing paste comprising at least one disperse dye, at least one cationic dyeing assistant and at least one nonionic detergent, it being possible for steps A) and B) to be carried out in any sequence and for step B) to be repeated several times with different dyes, the fibre material treated in this way is dried and the dye is then fixed on the fibre material by a heat treatment.

Suitable disperse dyes for the process according to the invention are those dyes which are described under "Disperse Dyes" in the Colour Index, 3rd edition (3rd Revision 1987 including additions and amendments up to No. 85). These are, for example, carboxylic acid and/or sulfonic acid group-free nitro, amino, aminoketone, ketonimine, methine, polymethine, diphenylamine, quinoline, benzimidazole, xanthene, oxazine or coumarin dyes, and in particular anthraquinone and azo dyes, such as mono- or disazo dyes.

Dyes which are preferred for the process according to the invention are those of the formulae (1)

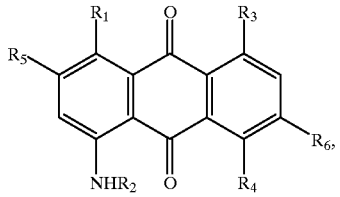

in which $R_1$ is hydroxyl or amino, $R_2$ is hydrogen, or phenyl which is unsubstituted or substituted by $C_1$–$C_4$alkyl, $C_1$–$C_4$alkoxy, hydroxy-$C_1$–$C_4$alkyl or $C_1$–$C_4$sulfo, $R_3$ is hydrogen, hydroxyl, amino or nitro, $R_4$ is hydrogen, hydroxyl, amino or nitro, $R_5$ is hydrogen, halogen or $C_1$–$C_4$alkoxy, and $R_6$ is hydrogen, halogen or —O—$(CH_2)_2$—O—$COOR_7$, in which $R_7$ is $C_1$–$C_4$-alkyl or phenyl, (2)

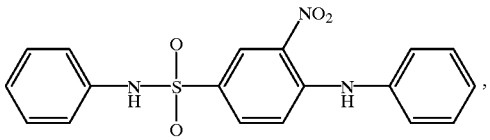

(3)

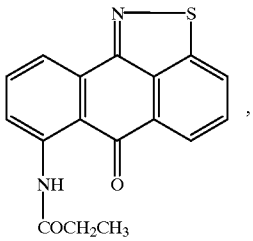

(4)

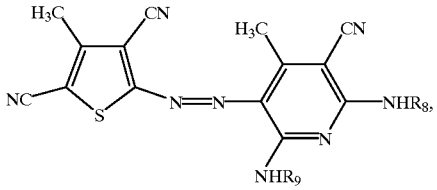

in which $R_8$ and $R_9$ independently of one another are hydrogen, —$(CH_2)_2$—O—$(CH_2)_2$—OX or —$(CH_2)_3$—O—$(CH_2)_4$—OX, in which X is hydrogen or —$COCH_3$, (5)

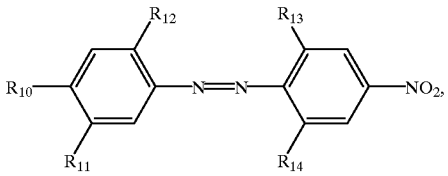

in which $R_{10}$ is amino which is mono- or disubstituted by —$(CH_2)_2$—O—$COCH_3$, —$(CH_2)_2$—CN, —CH$(CH_3)$—$COOCH_3$ or —$CH_2$—C(OH)$CH_3$, $R_{11}$ is hydrogen, $C_1$–$C_4$alkyl or halogen, $R_{12}$ is hydrogen or $NHCOR_{15}$, in which $R_{15}$ is $C_1$–$C_3$alkyl, $R_{13}$ is hydrogen or halogen and $R_{14}$ is halogen, nitro or cyano, (6)

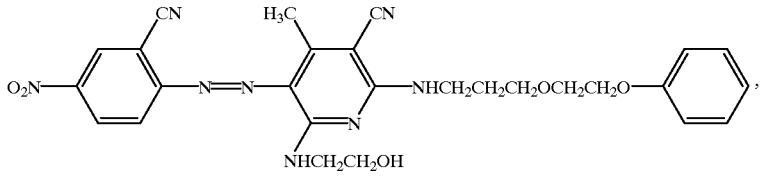

(7)

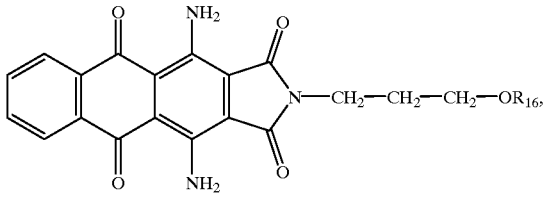

in which $R_{16}$ is methyl, ethyl or —$(CH_2)_2$—O—$C_1$–$C_2$alkyl, and (8)

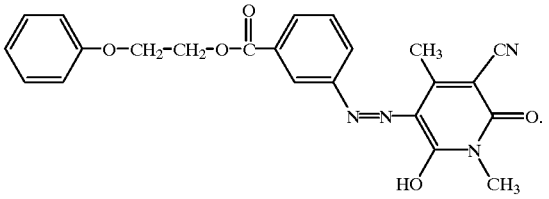

The amounts in which the disperse dyes are used in the dyebaths or printing pastes can vary according to the desired depth of shade; in general, amounts of 0.01 to 15 percent by weight, in particular 0.1 to 10 percent by weight, based on the total sum of the dyes, per 1 l of liquor, or 0.01 to 400 g, in particular 0.2 to 300 g, especially 0.5 to 200 g of the dyes per kg of printing paste have proved advantageous.

If the hydrophobic fibre material is dyed in step A), a continuous dyeing process, for example the padding process, is usually used. If appropriate, the dyed material is dried before further treatment.

In addition to the dye, the dye liquor can also comprise generally customary additives, for example acid donors, for example aliphatic amine chlorides or magnesium chloride, aqueous solutions of inorganic salts, for example of alkali metal chlorides or alkali metal sulfates, alkali metal hydroxides, urea, thickeners, for example alginate thickeners, water-soluble cellulose alkyl ethers and levelling, antifoam and/or deaerating agents, penetration accelerators, migration inhibitors and wetting agents.

The printing paste used, if appropriate, in step A) is a printing paste customary in printing which, in addition to the dye, comprises the customary dyeing assistants, for example advantageously thickeners of natural or synthetic origin, for example commercially available alginate thickeners, starch ethers or locust bean flour, in particular sodium alginate, by itself or as a mixture with modified cellulose, in particular with preferably 20 to 25 percent by weight of carboxymethylcellulose.

Synthetic thickeners are preferably employed in the above printing paste, for example those based on poly(meth)acrylic acids, poly(meth)acrylamides and co- and terpolymers thereof. If desired, the printing paste can also comprise acid donors, such as butyrolactone or sodium hydrogen phosphate, preservatives, sequestering agents, emulsifiers, water-insoluble solvents, oxidizing agents or deaerating agents.

Cationic dyeing assistants in the printing paste used in step B) are, in particular, organic polymer compounds containing quaternized amines, or salts of nitrogen-containing organic polymer compounds.

These are, in particular, organic polymer compounds based on polymono- and polydiallylamines, for example polydiallylammonium hydrochloride or polydiallyldimethylammonium chloride.

The printing paste usually comprises 0.5 to 20, preferably 1 to 10 g of the cationic dyeing assistant per 1 kg of the printing paste.

Nonionic detergents which are used in the printing paste used in step B) are, for example, fatty acid polyglycol esters, or, in particular, those compounds which are formed by addition of 4 to 80 ethylene oxide and/or propylene oxide units onto fatty alcohols, fatty amines, fatty acids or alkylaryls, for example nonyl- or octylphenol.

Examples of these compounds are cetyl alcohol with 4–6 ethylene oxide units, cetyl alcohol with 10–14 ethylene oxide units, tallow fatty alcohol with 10 to 25 ethylene oxide units, lauryl alcohol with 5–8 ethylene oxide units, nonylphenol with 3 to 10 ethylene oxide units, castor oil with 36 ethylene oxide units or oleic acid with 5 to 15 ethylene oxide units.

Non-foaming or low-foaming nonionic detergents are advantageously employed in the process according to the invention.

The printing paste usually comprises 1 to 60, preferably 5 to 40 g of the nonionic detergent per 1 kg of the printing paste.

In addition to the abovementioned components, the printing paste used in step B) can comprise further customary auxiliaries, for example advantageously thickeners of natural or synthetic origin, for example commercially available alginate thickeners, starch ethers or locust bean flour ethers, in particular sodium alginate, by itself or as a mixture with modified cellulose, in particular with preferably 20 to 25 percent by weight of carboxymethylcellulose. Synthetic thickeners, for example those based on poly(meth)acrylic acids, poly(meth)acrylamides and co- and terpolymers thereof, can also be employed in the printing pastes according to the invention.

If desired, the printing pastes can also comprise acid donors, such as butyrolactone or sodium hydrogen phosphate, preservative, sequestering agents, emulsifiers, water-insoluble solvents, oxidizing agents or deaerating agents.

Preservatives are, in particular, formaldehyde-releasing agents, for example paraformaldehyde and trioxane, in particular aqueous, approximately 30 to 40 percent by weight formaldehyde solutions, sequestering agents are, for example, sodium nitrilotriacetate, sodium ethylenediaminetetraacetate, and especially sodium polymetaphosphate, and in particular sodium hexametaphosphate, emulsifiers are, in particular, adducts of an alkylene oxide and a fatty alcohol, in particular an adduct of oleyl alcohol and ethylene oxide, water-insoluble solvents are high-boiling, saturated hydrocarbons, in particular paraffins having a boiling range of about 160 to 210° C. (so-called white spirits), oxidizing agents are, for example, an aromatic nitrocompound, in particular an aromatic mono- or dinitrocarboxylic acid or -sulfonic acid, which is present, if appropriate, as an alkylene oxide adduct, in particular a nitrobenzenesulfonic acid, and deaerating agents are, for example, high-boiling solvents, in particular turpentine oils, higher alcohols, preferably $C_8$ to $C_{10}$ alcohols, terpene alcohols or deaerating agents based on mineral and/or silicone oils, in particular commercial formulations of about 15 to 25 percent by weight of a mineral and silicone oil mixture and about 75 to 85 percent by weight of a $C_8$ alcohol, for example 2-ethyl-n-hexanol.

The process according to the invention can be used for various types of hydrophobic fibre materials.

Polyester fibre materials are preferred.

Polyester fibre materials are those materials which consist entirely or partly of polyester.

Examples are cellulose ester fibres, for example cellulose-2½-acetate fibres and triacetate fibres, and in particular linear polyester fibres, which may also be acid-modified, and which are obtained, for example, by condensation of terephthalic acid with ethylene glycol or of isophthalic acid or terephthalic acid with 1,4-bis(hydroxymethyl)-cyclohexane, and fibres of copolymers of terephthalic and isophthalic acid with ethylene glycol. Polyester-containing blend materials, i.e. mixtures of polyester and other fibres, in particular cotton/polyester fibre materials, are furthermore suitable.

Woven fabrics, knitted fabrics or webs of these fibres are chiefly used.

In the case of printing of the hydrophobic fibre materials, the printing paste is applied directly to the fibre material over the entire area or in areas, printing machines of the customary design, for example intaglio printing, rotary screen printing and flatbed printing machines, advantageously being employed.

The process according to the invention is preferably carried out in a "one-step process" on the "H.W. Dyeing & Discharge Printing Line" apparatus of Johannes Zimmer, A-9020 Klagenfurt (Patent applied No. A 468/95).

After the printing, the fibre material is dried at temperatures up to 150° C., preferably 80° C. to 120° C.

Subsequent fixing of the fibre material is in general effected by dry heat (thermofixing) or superheated steam under atmospheric pressure (HT fixing). The fixing in these cases is carried out under the following conditions:

HT fixing: 5 to 10 minutes at 170 to 190° C.

Thermofixing: 1 to 2 minutes at 170 to 220° C.

After the fixing, the prints are as a rule washed out and then finished in the customary manner by cleaning in an alkaline medium under reductive conditions, for example by means of sodium dithionite. After the cleaning, the prints are rinsed again and dried.

The prints on polyester fibre materials which are obtainable by the process according to the invention have good all-round properties, they have, for example, a high fibre-dye bond stability, both in the acid and in the alkaline range, and good wet fastness properties, such as fastness to washing, water, seawater and perspiration, a good fastness to chlorine, fastness to rubbing, fastness to ironing and fastness to pleating, and are distinguished, in particular, by an extension of the brilliant colour shades with high fastnesses to light and hot light.

The following examples serve to illustrate the invention. The temperatures are stated in degrees Celsius, parts are parts by weight and percentage data are based on % by weight, unless stated otherwise. Parts by weight bear the same relationship to parts by volume as the kilogram to the liter.

EXAMPLE 1

A polyester pile fabric is padded (liquor pick-up about 150%) with a liquor comprising 120 g/l of a commercially available 6% alginate thickener, 30 g/l of a formulation comprising 10% of a thickener based on starch ether, 8 g/l of a commercially available deaerator based on aliphatic hydrocarbons and alcohols, 4 g/l of sodium phosphate, 8 g/l of sodium chlorate, 54 g/l of a commercially available formulation comprising about 20% of a triazine UV absorber, 1.62 g/l of the dye of the formula (8)

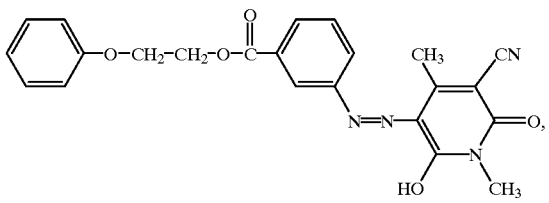

2.37 g/l of the dye of the formula (6)

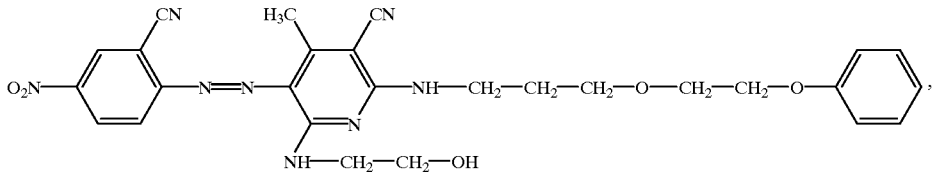

0.8 g/l of the dye of the formula (100)

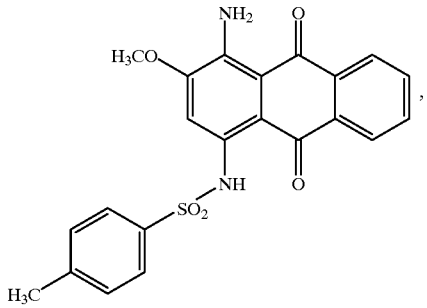

0.61 g/l of the dye of the formula (101)

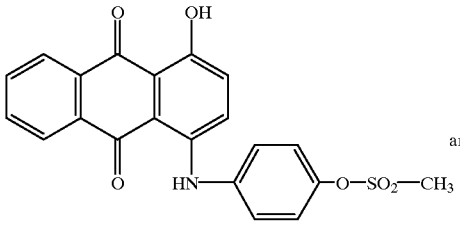

and 9.29 g/l of the dye of the formula (102)

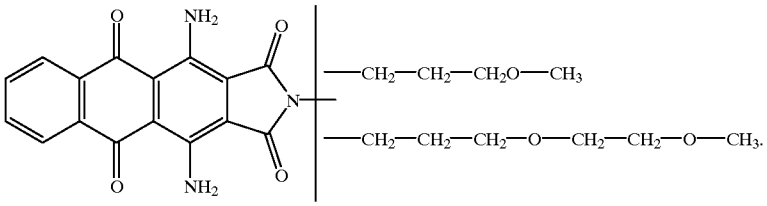

The dyed polyester fabric is dried at 80° C. and then printed in areas with a printing paste comprising, per 1 kg of printing paste, 440 g of a formulation comprising 10% of a thickener based on starch ether, 8 g of a commercially available deaerator based on aliphatic hydrocarbons and alcohols, 4 g of sodium phosphate, 8 g of sodium chlorate, 54 g of a commercially available formulation comprising about 20% of a triazine UV absorber, 25 g of an addition product of 36 ethylene oxide units on 1 mol of castor oil, 3 g of polydiallyldimethylammonium chloride and 25 g of the dye of the formula (102).

The treated polyester fabric is then dried and fixed with HT steam at 180° C. for 8 minutes.

After the fixing, the printed polyester fabric is washed out by the customary process, cleaned reductively and dried.

A two-coloured grey-blue resist print with sharp contours and a very good fastness to hot light is obtained.

EXAMPLE 2

A polyester pile fabric is printed over the entire area with a printing paste comprising, per 1 kg of printing paste, 256 g of a commercially available 6% alginate thickener, 64 g of a formulation comprising 10% of a thickener based on starch ether, 8 g of a commercially available deaerator based on aliphatic hydrocarbons and alcohols, 4 g of sodium phosphate, 8 g of sodium chlorate, 54 g of a commercially available formulation comprising about 20% of a triazine UV absorber, 1.62 g of the dye of the formula (8), 2.37 g of the dye of the formula (6), 0.8 g of the dye of the formula (100), 0.61 g of the dye of the formula (101) and 9.29 g of the dye of the formula (102).

The printed polyester fabric is then printed in areas with a printing paste comprising, per 1 kg of printing paste, 440 g of a formulation comprising 10% of a thickener based on starch ether, 8 g of a commercially available deaerator based on aliphatic hydrocarbons and alcohols, 4 g of sodium phosphate, 8 g of sodium chlorate, 54 g of a commercially available formulation comprising about 20% of a triazine UV absorber, 25 g of an addition product of 36 ethylene oxide units on 1 mol of castor oil, 3 g of polydiallyldimethylammonium chloride, 12 g of the dye of the formula (6) and 4 g of the dye of the formula (100).

The printed polyester fabric is then dried and fixed with HT steam at 1 80° C. for 8 minutes.

After the fixing, the printed polyester fabric is washed out by the customary process, cleaned reductively and dried.

A two-coloured grey-red resist print with sharp contours and a very good fastness to hot light is obtained.

EXAMPLE 3

A polyester pile fabric is printed in areas with a printing paste comprising, per 1 kg of printing paste, 440 g of a formulation comprising 10% of a thickener based on starch ether, 8 g of a commercially available deaerator based on aliphatic hydrocarbons and alcohols, 4 g of sodium phosphate, 8 g of sodium chlorate, 54 g of a commercially available formulation comprising about 20% of a triazine UV absorber, 25 g of an addition product of 36 ethylene oxide units on 1 mol of castor oil, 3 g of polydiallyldimethylammonium chloride and 8 g of the dye of the formula (101) and is then printed over the entire area with a printing paste comprising, per 1 kg of printing paste, 256 g of a commercially available 6% alginate thickener, 64 g of a formulation comprising 10% of a thickener based on starch ether, 8 g of a commercially available deaerator based on aliphatic hydrocarbons and alcohols, 4 g of sodium phosphate, 8 g of sodium chlorate, 54 g of a commercially available formulation comprising about 20% of a triazine UV absorber, 1.62 g of the dye of the formula (8), 2.37 g of the dye of the formula (6), 0.8 g of the dye of the formula (100), 0.61 g of the dye of the formula (101) and 9.29 g of the dye of the formula (102).

The printed polyester fabric is then dried and fixed with HT steam at 180° C. for 8 minutes.

After the fixing, the printed polyester fabric is washed out by the customary process, cleaned reductively and dried.

A two-coloured grey-violet resist print with sharp contours and a very good fastness to hot light is obtained.

EXAMPLE 4

A polyester pile fabric is printed over the entire area with a printing paste comprising, per 1 kg of printing paste, 256 g of a commercially available 6% alginate thickener, 64 g of a formulation comprising 10% of a thickener based on starch ether, 8 g of a commercially available deaerator based on aliphatic hydrocarbons and alcohols, 4 g of sodium phosphate, 8 g of sodium chlorate, 54 g of a commercially available formulation comprising about 20% of a triazine UV absorber, 1.62 g of the dye of the formula (8), 2.37 g of the dye of the formula (6), 0.8 g of the dye of the formula (100), 0.61 g the dye of the formula (101) and 9.29 g of the dye of the formula (102).

The printed polyester fabric is then printed in areas with a printing paste comprising, per 1 kg of printing paste, 440 g of a formulation comprising 10% of a thickener based on starch ether, 8 g of a commercially available deaerator based on aliphatic hydrocarbons and alcohols, 4 g of sodium phosphate, 8 g of sodium chlorate, 54 g of a commercially available formulation comprising about 20% of a triazine UV absorber, 25 g of an addition product of 36 ethylene oxide units on 1 mol of castor oil, 3 g of polydiallyldimethylammonium chloride, 12 g of the dye of the formula (6) and 4 g of the dye of the formula (100), and is then printed in areas elsewhere with a printing paste comprising, per 1 kg of printing paste, 440 g of a formulation comprising 10% of a thickener based on starch ether, 8 g of a commercially available deaerator based on aliphatic hydrocarbons and alcohols, 4 g of sodium phosphate, 8 g of sodium chlorate, 54 g of a commercially available formulation comprising about 20% of a triazine UV absorber, 25 g of an addition product of 36 ethylene oxide units on 1 mol of castor oil, 3 g of polydiallyldimethylammonium chloride and 6 g of the dye of the formula (8).

The printed polyester fabric is then dried and fixed with HT steam at 180° C. for 8 minutes.

After the fixing, the printed polyester fabric is washed out by the customary process, cleaned reductively and dried.

A three-coloured grey-red-yellow resist print with sharp contours and a very good fastness to hot light is obtained.

EXAMPLE 5

A polyester pile fabric is padded (liquor pick-up about 150%) with a liquor comprising 150 g/l of a commercially available 9% alginate thickener, 6 g/l of a commercially available deaerator based on aliphatic hydrocarbons and alcohols, 4 g/l of sodium phosphate, 8 g/l of sodium chlorate, 50 g/l of a commercially available formulation comprising about 20% of a triazine UV absorber, 5 g/l of a commercially available dispersing agent, 1.54 g/l of the dye of the formula (103)

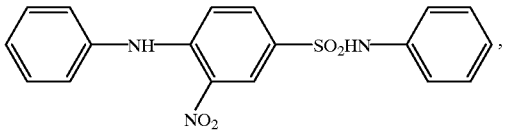

1.39 g/l of the dye of the formula (6), 0.51 g/l of the dye of the formula (100), 0.28 g/l of the dye of the formula (101), and 1.98 g/l of the dye of the formula (103).

The dyed polyester fabric is dried at 80° C. and then printed in areas with a printing paste comprising, per 1 kg of printing paste, 400 g of a formulation comprising 9% of a thickener based on starch ether, 8 g of a commercially available deaerator based on aliphatic hydrocarbons and alcohols, 50 g of a commercially available formulation comprising about 20% of a triazine UV absorber, 24 g of an addition product of 36 ethylene oxide units on 1 mol of castor oil, 10 g of polydiallyldimethylammonium chloride and 28 g of the dye of the formula (103).

The treated polyester fabric is then dried and fixed with HT steam at 180° C. for 8 minutes.

After the fixing, the printed polyester fabric is washed out by the customary process, cleaned reductively and dried.

A two-coloured grey-yellow resist print with sharp contours and a very good fastness to hot light is obtained.

What is claimed is:

1. A process for printing hydrophobic fibre materials with disperse dyes, which comprises a procedure in which the fibre materials A) are dyed over the entire area or printed over the entire area with a disperse dye and B) are printed in areas with a printing paste comprising at least one disperse dye,
at least one cationic dyeing assistant and
at least one nonionic detergent it being possible for steps A) and B) to be carried out in any sequence and for step B) to be repeated several times with different dyes, the fibre material treated in this way is dried and the dye is then fixed on the fibre material by a heat treatment.

2. A process according to claim 1, wherein the hydrophobic fibre materials are first dyed over the entire area or printed over the entire area with a disperse dye and are then printed in areas, once or several times, with a printing paste comprising at least one disperse dye, at least one cationic dyeing assistant and at least one nonionic detergent.

3. A process according to claim 1, wherein the hydrophobic fibre materials are first printed in areas, once or several times, with a printing paste comprising at least one disperse dye, at least one cationic dyeing assistant and at least one nonionic detergent and are then dyed over the entire area or printed over the entire area with a disperse dye.

4. A process according to claim 1, wherein the hydrophobic fibre material is dyed in step A).

5. A process according to claim 1, wherein the hydrophobic fibre material is printed in step A).

6. A process according to claim 1, wherein polyester fibre materials are used as the hydrophobic fibre materials.

* * * * *